US005609133A

United States Patent [19]

Håkansson

[11] Patent Number: 5,609,133

[45] Date of Patent: Mar. 11, 1997

[54] EXHAUST VALVE MECHANISM IN AN INTERNAL COMBUSTION ENGINE

[75] Inventor: Nils-Olof Håkansson, Stenkullen, Sweden

[73] Assignee: AB Volvo, Gothenburg, Sweden

[21] Appl. No.: 535,026

[22] PCT Filed: Apr. 26, 1994

[86] PCT No.: PCT/SE94/00370

§ 371 Date: Oct. 18, 1995

§ 102(e) Date: Oct. 18, 1995

[87] PCT Pub. No.: WO94/25740

PCT Pub. Date: Nov. 10, 1994

[30] Foreign Application Priority Data

Apr. 27, 1993 [SE] Sweden ..... 9301416

[51] Int. Cl.[6] ..... F01L 1/24; F01L 13/06

[52] U.S. Cl. ..... 123/321; 123/90.16; 123/90.46

[58] Field of Search ..... 123/90.12, 90.15, 123/90.16, 90.39, 90.44, 90.46, 321

[56] References Cited

U.S. PATENT DOCUMENTS 4,261,307 4/1981 Oldberg ..... 123/90.16
4,711,210 12/1987 Reichenbach ..... 123/321
5,036,810 8/1991 Meneely ..... 123/321
5,107,803 4/1992 Furnivall ..... 123/90.16

FOREIGN PATENT DOCUMENTS 466320 1/1992 Sweden .
468132 11/1992 Sweden .

*Primary Examiner*—Weilun Lo
*Attorney, Agent, or Firm*—Young & Thompson

[57] ABSTRACT

Exhaust valve mechanism with a rocker arm (1) having a hydraulic circuit with a hydraulically operated valve play absorbing piston element (7). The hydraulic circuit contains a piston pump (20, 21) housed in the rocker arm and which is driven by an ordinary cam lobe (4) on the engine cam shaft (5). The piston (21) of the piston pump has a cam follower (23) spaced at a predetermined cam angle distance (a) from the ordinary cam follower (3) of the rocker arm. The pump is in communication via a channel (24) and intermediate regulator valve (30) with the cylinder (6) of the valve play absorbing piston element. With the regulator valve, the piston element (7) can be shifted to open the exhaust valve during a latter portion compression stroke to achieve so-called compression braking.

11 Claims, 3 Drawing Sheets

EXHAUST VALVE MECHANISM IN AN INTERNAL COMBUSTION ENGINE

FIELD OF THE INVENTION

The present invention relates to an exhaust valve mechanism in an internal combustion engine, comprising at least one exhaust valve in each cylinder, a rocker arm, mounted on a rocker arm shaft, for each cylinder for operating the exhaust valve, a cam shaft with a cam lobe for each rocker arm, said cam lobe cooperating with a first follower at one end of the rocker arm, a valve play absorbing device arranged between an opposite end of the rocker arm and the exhaust valve, said valve play absorbing device comprising a piston element which is housed in a first cylinder chamber disposed in said opposite rocker arm end, and a hydraulic circuit for supplying or draining hydraulic oil to or from said cylinder chamber.

BACKGROUND OF THE INVENTION

SE-A-468132 reveals an exhaust valve mechanism of the above type which, together with a special type of cam shaft with an extra small cam lobe, can be used to increase the braking power of the engine. The extra cam lobe is dimensioned so that its lift approximately corresponds to the normal valve play in the valve mechanism. By reducing, by means of the valve play absorbing mechanism, the valve play to zero, an extra lift can be achieved of the exhaust valve corresponding to the normal valve play, during a suitable time interval. For example, the extra cam lobe can be placed relative to the ordinary cam lobe, so that an extra exhaust valve lift is obtained during a latter portion of the compression stroke, resulting in loss, during the compression stroke, of a portion of the compression work, which cannot be recovered during the expansion stroke. The result is an increase in the engine braking power.

An engine with such an arrangement for increasing-the braking power has, however, a somewhat lower efficiency than a corresponding conventional engine. This is due to the fact that the maximum lift of the exhaust valves at zero valve play is utilized for brake mode and not for engine mode, which means that engine mode must be compensated by lower lift when the valve play absorbing device is not activated, which also means that the exhaust valves close earlier than if a maximum lift can be used for engine mode. An additional disadvantage of the known arrangement is that it requires a special cam shaft.

SUMMARY OF THE INVENTION

The purpose of the present invention is to achieve an exhaust valve mechanism of the type described by way of introduction, which can be used together with a conventional cam shaft to achieve an engine where so-called compression braking is possible without a reduction in efficiency in comparison with the same engine without this braking capacity.

This is achieved according to the invention by virtue of the fact that the hydraulic circuit contains a hydraulic pump housed in the rocker arm and driven by the cam lobe, said hydraulic pump having a second cam follower arranged at a predetermined cam angle distance from the first cam follower and communicating via a channel with the first cylinder chamber.

According to the invention, the known arrangement with a rigid mechanical drive device in the form of an extra cam lobe on the cam shaft is replaced with a hydraulic drive device actuated by the ordinary cam lobe and which can be made in such a manner that the exhaust valve closing sequence in engine mode will be the same as in brake mode.

In a preferred embodiment of the valve mechanism according to the invention, the pump is a piston pump, which via the channel in the rocker arm, communicates with a pressure accumulator, in which an equalizing volume of hydraulic oil is introduced during the initial piston stroke, so that the volume fed into the first cylinder chamber will be less than the stroke volume of the piston pump. By also coordinating the piston element of the valve play absorbing device with an abutment which limits the piston stroke and arranging a relief valve through which the hydraulic oil can be drained when the pressure in the hydraulic circuit rises after the piston element has reached its end position, a rapid transition is achieved at a suitable position of the cam curve and a well-defined stroke is achieved in the piston element of the valve play absorbing device.

BRIEF DESCRIPTION OF THE DRAWINGS

The invention will be described in more detail with reference to examples shown in the accompanying drawings, where.

DETAILED DESCRIPTION OF THE INVENTION

Figure 1:
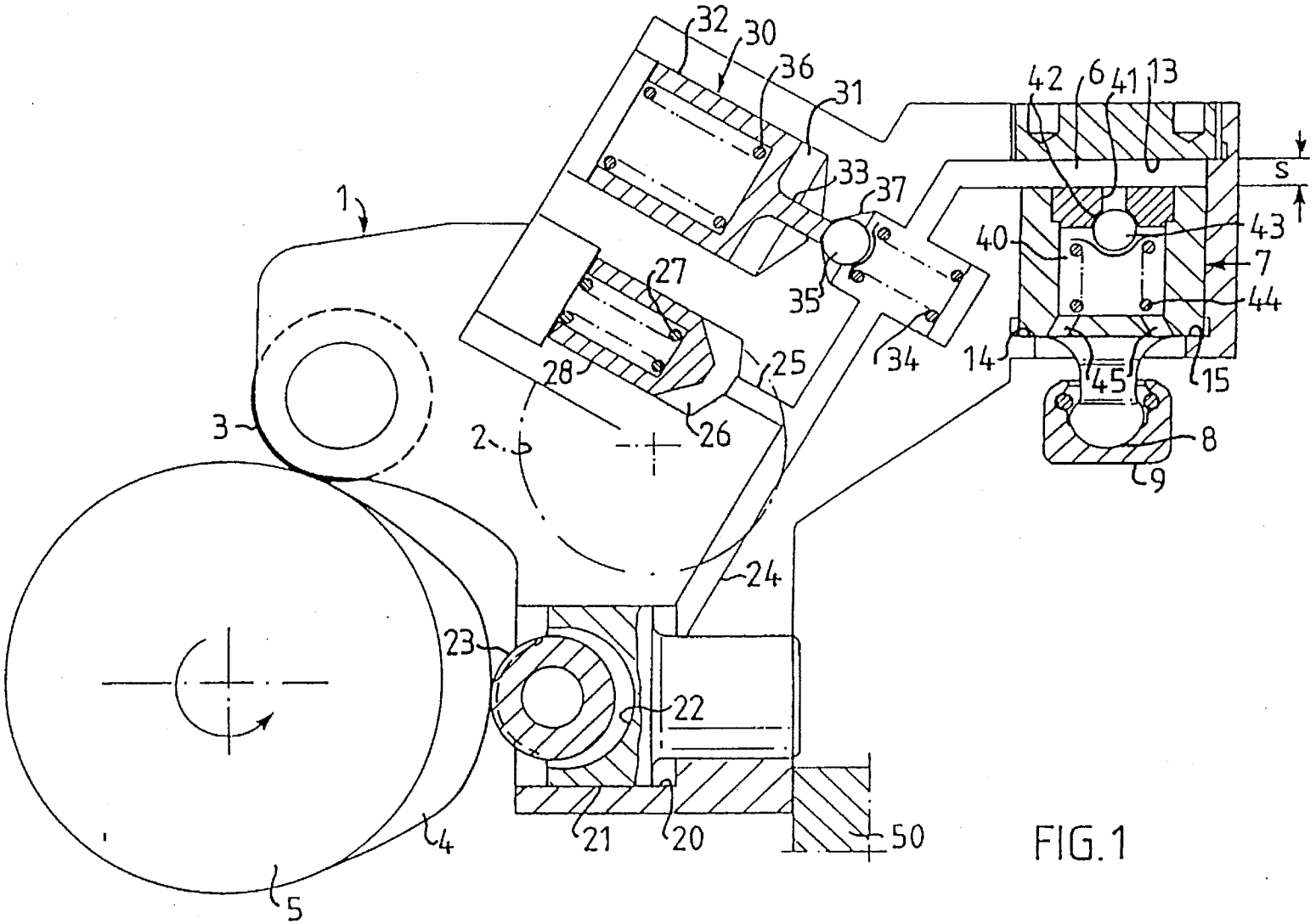
FIG. 1 shows in schematic form one embodiment of a rocker arm included in a valve mechanism according to the invention.
Figure 2:
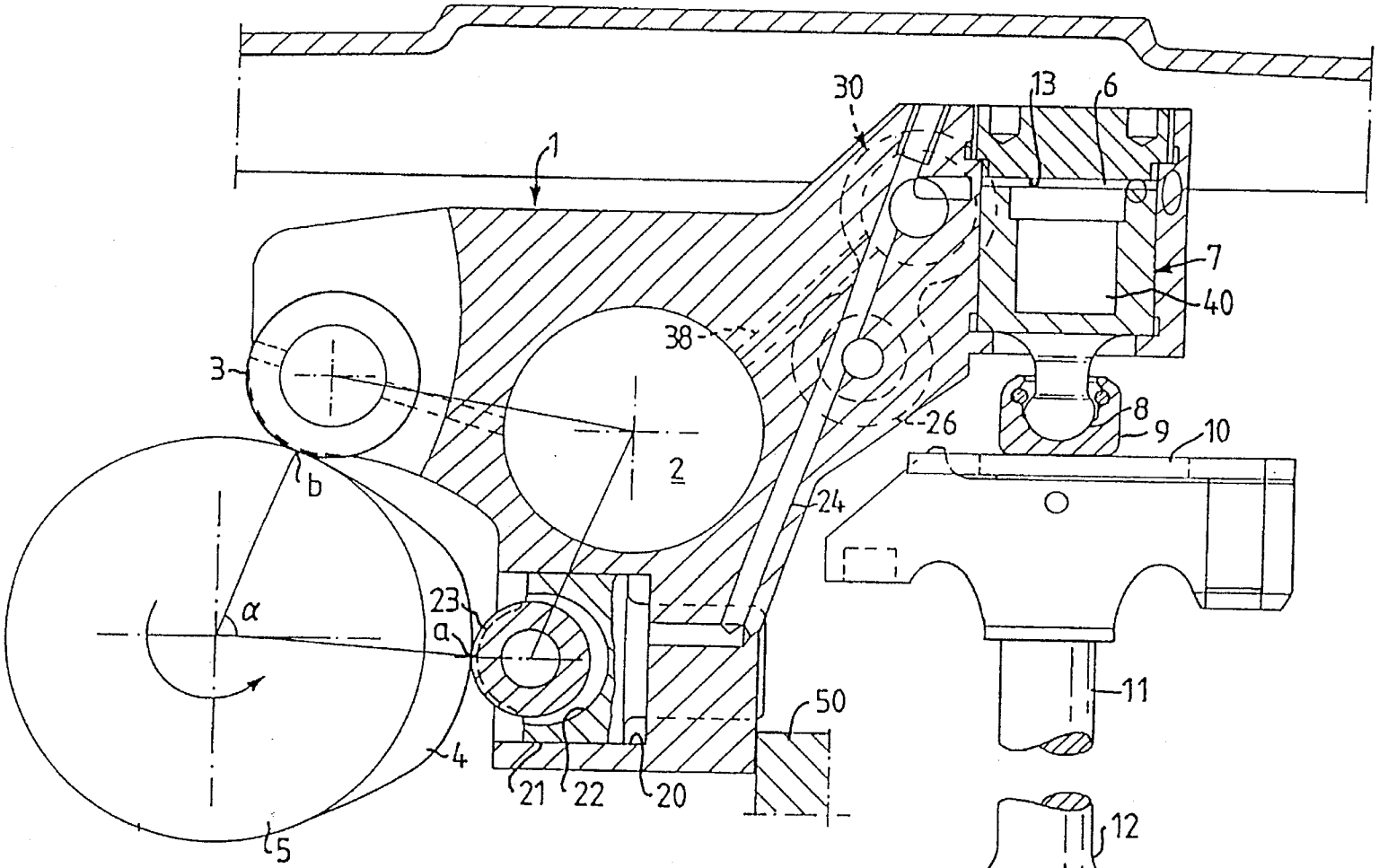
FIG. 2 is a longitudinal section through a preferred embodiment of the rocker arm in FIG. 1.

In FIGS. 1 and 2, the numeral 1 designates a rocker arm with a bore 2 for journalling the rocker arm on a rocker arm shaft (not shown) of a type known per se. At one end the rocker arm 1 is provided with a cam follower in the form of a rotatably journalled roller 3 which, together with a cam lobe 4 on a cam shaft 5 imparts the rocker arm a rocking movement in a known manner. At its opposite end the rocker arm is provided with a cylinder chamber 6, in which a piston element 7 is slidably housed. The piston element 7 is provided at its distal end with a ball 8 which is enclosed in a spherical depression in a gate 9 which rests on a yoke 10, interconnecting the valve spindles 11 (one shown) of a pair of exhaust valves 12 in an engine cylinder (not shown). The piston element 7 is slidable between an inner end position, in which its upper surface is in contact with the bottom surface 13 of the cylinder chamber 6, and an outer end position, in which its outer edge 14 is in contact with an annular abutment surface 15 of the cylinder chamber. The length of stroke "S" of the piston element 7 can be as much as about 2 mm but in a practical embodiment has been selected as 1.6 mm. By supplying or draining hydraulic oil to or from the cylinder chamber 6, the lift of the exhaust valves 12 can thus be varied by a distance "S".

Figure 3:
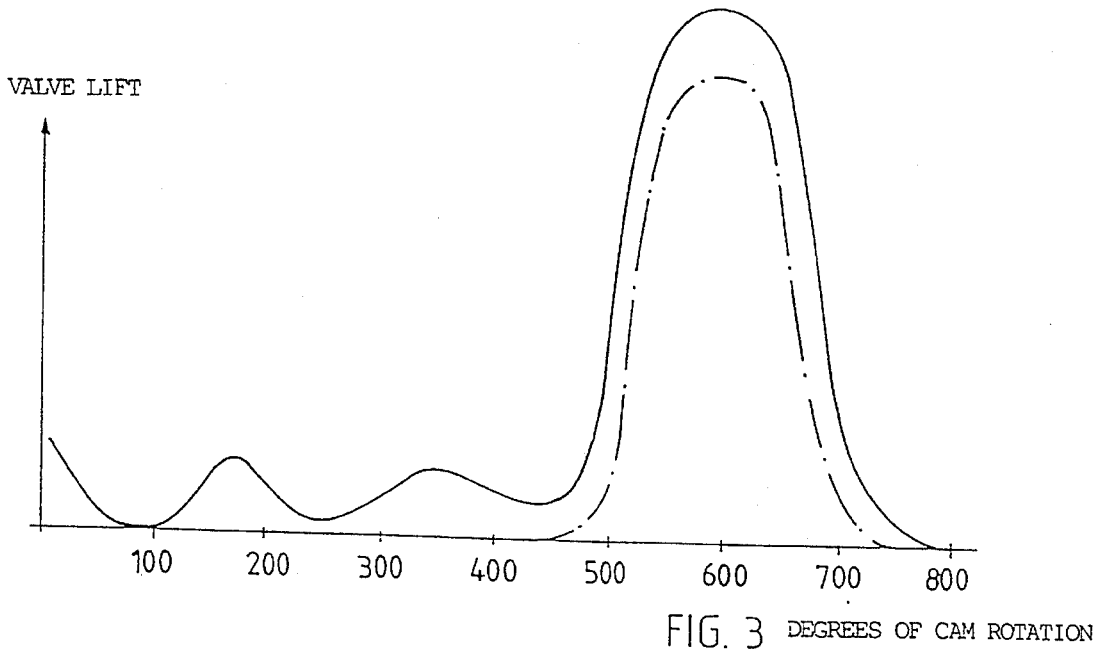
FIG. 3 is a diagram illustrating the lift of the exhaust valve in a previously known engine, which has a cam shaft with extra cam lobes for compression braking.

In an embodiment known by e.g. SE-A-466 320 of an engine equipped for compression braking, a small extra cam lobe is used, which during a latter portion of the compression stroke opens the exhaust valve when a valve play absorbing element is actuated. The exhaust valve is thus provided with a valve cycle which is illustrated by the solid line curve in FIG. 3. In engine mode, when the valve play absorbing element is deactivated, the exhaust valve has the valve lift sequence illustrated with the dash-dot line in FIG. 3, involving earlier closing of the exhaust valve than with a corresponding engine not equipped for compression braking.

Figure 4:
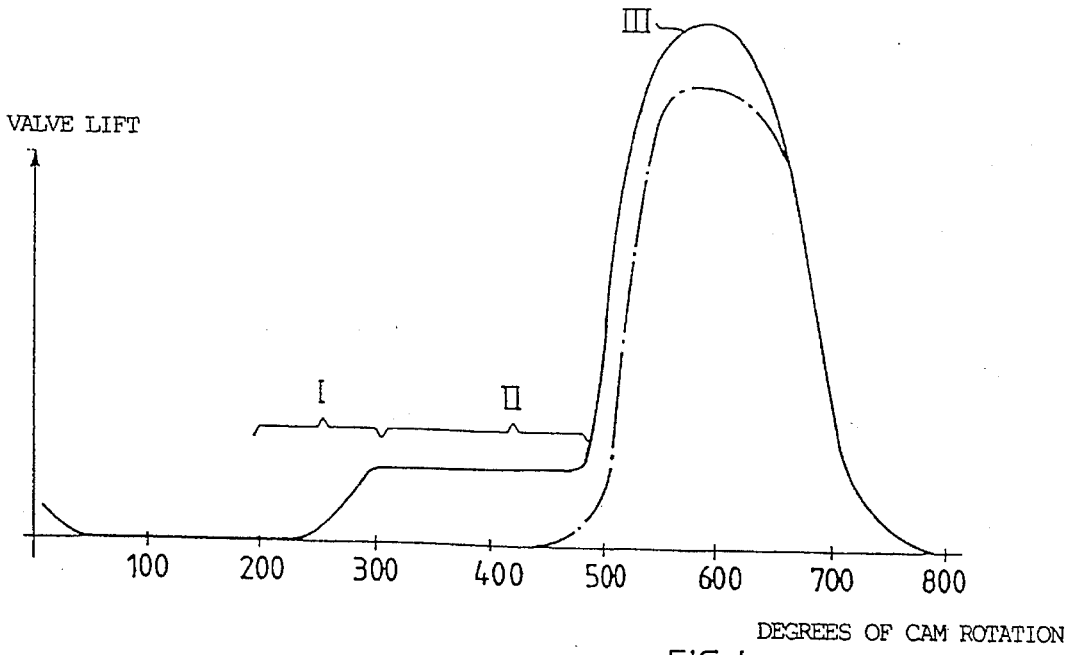
FIG. 4 is a diagram corresponding to FIG. 3 for an engine with a valve mechanism according to the invention.

According to the present invention, the rocker arm 1 is provided with a hydraulic system, by means of which the closing sequence of the exhaust valve 12 in engine mode and brake mode follows the same curve, with the exception of the initial phase, as is illustrated in the diagram in FIG. 4 and which will be described in more detail below.

The hydraulic system comprises a piston 21 housed in a pump cylinder 20, said piston having a depression 22 in which a cam follower in the form of a roller 23 is rotatably mounted. The pump cylinder 20 is joined via a channel 24 with the cylinder chamber 6 of the valve play absorbing piston element 7. From the channel 24 a channel 25 branches off to a pressure accumulator chamber 26 containing a piston element 28 biased by a spring 27. A regulator valve, generally designated 30, has a regulator piston 32, which is slidable in a chamber 31 and has a spindle 33, the outer end of which is directed towards a spring 34 biased valve element in the form of a ball 35. The regulator piston 32 is biased by a spring 36 providing a greater force than the spring 34, which normally holds the ball 35 lifted from its seat 37, so that the channel 24 communicates with the chamber 31, which in turn, via a channel 38 (FIG. 2) and channels in the rocker arm shaft (not shown) are in communication with the engine lubricating oil system. The piston element 7 is made with a cavity 40 which communicates with the cylinder chamber 6 via a channel 41, one end of which forms a valve seat 42 for a valve element in the form of a ball 43, which is biased towards the seat by a spring 44. The components 42, 43 and 44 form a relief valve which, at a predetermined pressure in the cylinder 6, opens to allow oil to drain via the channels 45 in the piston element 7.

The cam follower 23 of the pump piston 21 is located at a cam angle distance $\alpha$ from the cam follower 3, said angular distance being selected so that the cam follower 23 of the pump piston will be on or after the top a of the cam lobe 4 when the cam follower 3 reaches the starting point b of the cam lobe, as is illustrated in FIGS. 1 and 2. In the example shown, the angle $\alpha$ is approximately 75°, but the interval for $\alpha$ is 60°–90°. The piston area of the pump piston 21 is less than the area of the piston 7 to create a mechanical advantage. In the example shown the area ratio is 1:1.8.

The valve mechanism described functions as follows:

In normal operation, i.e. engine mode, there will be a low pressure in the rocker arm shaft (not shown) and consequently in the regulator valve chamber 31 as well. This pressure can be as much as 1 bar, so that the force of the spring 36 will overpower the force of the spring 34, so that the valve ball 35 will be lifted and held from its seat and the pump cylinder 20 will be in communication with the chamber 31 via the channel 24. The piston element 7 is in its inner end position against the bottom 13 of the cylinder chamber 6 and the pressure accumulator piston 28 is held in its outer rest position by the spring 27. The pump piston 21 is loaded outwards by the low pressure in the system so that there will be zero play between the cam follower 23 and the cam lobe 4, the pump cylinder 20 being kept filled with oil.

When operation is to be shifted from engine mode to brake mode, the pressure in the rocker arm shaft is increased, thus increasing the pressure in the regulator valve chamber 31, which can be achieved in a known manner, e.g. in that described in SE-A-468 132. The pressure is sufficiently raised so that the pressure acting on the regulator valve piston 32 in the chamber 31 generates a force which overcomes the force of the spring 36 and displaces the valve piston 32 to its inner position shown in FIG. 1, so that the valve ball 35 blocks the communication between the pump cylinder 20 and the valve chamber 31. Oil which is now initially pumped out into the channel 24 when the pump piston 21 is pressed into the pump cylinder 20, will first be pumped into the pressure accumulator chamber 26 while the pressure accumulator piston 28 is displaced into the chamber 26. When the piston 28 reaches the bottom of the chamber 26, the pressure in the cylinder chamber 6 will rise and the piston element 7 is displaced until its edge 14 strikes the abutment surface 15 and stops the piston stroke. Additional increasing pressure in the cylinder 6 will cause the relief valve ball 43 to be lifted from its seat so that oil can be drained via the channels 45.

During the interval when the pump piston 21, under the influence of the cam lobe 4 carries out its piston stroke, the rocker arm 1 remains stationary, since the cam follower 3 during this interval moves along a circular arc up to the starting point b of the cam curve. In order to prevent the force of the pump piston 21 acting on the rocker arm 1 from creating an excessively high surface pressure between the cam follower 3 and the cam shaft 5, in the preferred embodiment an abutment is arranged, as is indicated at 50 in FIGS. 1 and 2, which takes the load off the rocker arm and thus off the cam follower 3 during the pump piston stroke. By dimensioning, as is indicated above, the pump piston 21 with a piston area which is about 30%–60% of the piston area of the piston element 7, a reasonable surface pressure is obtained between the cam lobe 4 and the cam follower 23 of the pump piston 21, but a large opening force between the piston 7 of the rocker arm and the exhaust valve 12.

The described mechanical advantage also provides a desired reduction in the stroke of the piston 7 relative to the pump piston stroke. Thus, in a practical embodiment with a maximum cam lift of 9 mm, the theoretical maximum piston stroke for the piston 7 (without abutment 15) would be 5 mm, and this means that the relief valve 42, 43, 44 will only need to take care of a small excess volume of oil if the stroke is limited to 1.6 mm than if there were no mechanical advantage.

The pressure accumulator 26, 27, 28 also acts to reduce the excess volume but its main purpose is to create a hydraulic "dead band" in the system so that the pushing out of the piston element 7 is initiated at a suitable point on the cam curve, which provides a rapid lift of the valve 12 by rapid transition of the piston element 7. In FIG. 4, the solid line curve section I illustrates the rapid opening of the exhaust valve 12 in brake mode, when the pressure accumulator 28 has reached the bottom. The curve section II illustrates the process up to when the cam follower 3 has reached the point b on the cam load 4 (see FIG. 4). As is evident, there is a constant lift during an angular interval of about 200° under the influence of the abutment 15 and the relief valve 42, 43, 44.

When the cam load follower passes the point b on the cam 4, the rocker arm 1 will begin tipping in the opening direction of the valve for "normal" opening of the exhaust valve 12. As the cam roller 3 rolls up onto the top of the lobe approaching maximum lift at III, the cam roller 23 of the pump piston 21 will pass its maximum and roll down on the backside of the cam lobe. This provides space in the pump cylinder 20 for expansion volume since the pump piston 21 can now move out, and this means that the piston element 7, under the influence of the force acting on the same from the exhaust valve 12, will be returned to its retracted inner position as oil is pumped back from the cylinder 6 to the pump cylinder 20.

Thus, the valve play absorbing piston element 7 will be inactive during the closing movement of the exhaust valve 12 during each cycle independently of whether the regulator valve 30 is set for braking mode or engine mode. This means that the closing of the valve in braking mode will follow the same curve as for engine mode (dash-dot curve), and this involves an increase in efficiency over the known process illustrated in FIG. 3. The fact that the maximum exhaust valve lift must be reduced, as was the case previously, in comparison with an engine lacking equipment for compression braking, is of minor importance in this context.

When shifting from braking mode to engine mode, the pressure in the chamber 31 is reduced, and the regulator piston 32 opens the valve 35 connecting the channel 24 to the low pressure side. The pressure accumulator piston 28 is returned to its outer end position by the spring 27.

I claim:

1. In an exhaust valve mechanism in an internal combustion engine, comprising at least one exhaust valve in each cylinder, a rocker arm, mounted on a rocker arm shaft, for each cylinder for operating the exhaust valve, a cam shaft with a cam lobe for each rocker arm, said cam lobe being in contact with a first follower at one end of the rocker arm, a valve play absorbing device arranged between an opposite end of the rocker arm and the exhaust valve, said valve play absorbing device comprising a piston element, which is housed in a first cylinder chamber disposed in said opposite rocker arm end, and a hydraulic circuit for supplying and draining hydraulic oil to and from said first cylinder chamber, the improvement wherein the hydraulic circuit comprises a hydraulic pump housed in the rocker arm and driven by the cam lobe, said hydraulic pump having a second cam follower arranged at a predetermined cam angle distance (a) from the first cam follower and communicating via a channel with the first cylinder chamber.

2. Valve mechanism according to claim 1, wherein the hydraulic pump is a pump piston, which is housed in a second cylinder chamber in the rocker arm, and which carries the second cam follower.

3. Valve mechanism according to claim 2, wherein the pump piston has a smaller diameter and longer stroke than the piston element of the valve play absorbing device.

4. Valve mechanism according to claim 3, wherein the piston area of the pump piston is 30%–60% of the piston area of the piston element of the valve play absorbing device.

5. Valve mechanism according to claim 2, wherein the end surface of the pump piston facing the cam lobe is made with a depression in which the second cam follower in the form of a roller is rotatably mounted.

6. Valve mechanism according to claim 2, wherein the second cam follower is arranged at said cam angle distance (a) before the first cam follower such that the pump piston will have reached its bottom position before the first cam follower reaches a starting point (b) of a cam curve of the cam lobe.

7. Valve mechanism according to claim 6, wherein the second cam follower is disposed at an angular distance of 60°–90° from the first cam follower.

8. Valve mechanism according to claim 2, wherein said channel communicates with a pressure accumulator, into which an equalizing volume of hydraulic oil is fed at the beginning of a piston stroke, so that a delay is created in the stroke of the valve play absorbing piston element relative to the piston pump stroke.

9. Valve mechanism according to claim 1, wherein the piston element of the valve play absorbing device is operatively associated with an abutment, which limits the stroke of the piston element, and the hydraulic circuit comprises a relief valve through which the hydraulic oil can be drained from said first cylinder chamber when the pressure in the hydraulic circuit rises after the piston element has reached its end position.

10. Valve mechanism according to claim 2, wherein the rocker arm cooperates with a fixed support, which is arranged to limit the rocking movement of the rocker arm away from the exhaust valve and to absorb the force exerted by the cam lobe via the pump piston on the rocker arm during the pump piston stroke.

11. Valve mechanism according to claim 1, wherein the rocker arm comprises a hydraulically operated regulator valve which drains the hydraulic circuit in its open position.

* * * * *